United States Patent [19]

Klein

[11] 4,119,050

[45] Oct. 10, 1978

[54] METHOD FOR THE MANUFACTURE OF A CAN LID HAVING A TRIPLE-FOLD, PUSHDOWN GATE

[76] Inventor: Gerald B. Klein, 13451 Stuart Ct., Broomfield, Colo. 80020

[21] Appl. No.: 758,128

[22] Filed: Jan. 10, 1977

[51] Int. Cl.[2] ..... B21D 51/38

[52] U.S. Cl. ..... 113/121 C; 113/116 V; 220/268

[58] Field of Search ..... 113/121 C, 116 V, 116 Y; 220/90.6, 268

[56] References Cited

U.S. PATENT DOCUMENTS

| | | | |
|---|---|---|---|
| 3,362,569 | 1/1968 | Geiger | 220/268 |
| 3,366,086 | 1/1968 | Fraze | 113/121 C |
| 3,888,199 | 6/1975 | Herrmann | 113/121 C |
| 3,951,298 | 4/1976 | Klein | 220/268 |
| 4,018,178 | 4/1977 | Klein et al. | 113/121 C |

*Primary Examiner*—Michael J. Keenan

*Attorney, Agent, or Firm*—Dennis O. Kraft

[57] ABSTRACT

In the manufacture of a gated can lid preparatory to attaching the lid to the body of a can, a pushdown gate is first formed in a metal blank prior to cutting the outline of the lid. The gate is cut in a panel which is integral with the lid, below an aperture in the lid, and beneath an underfolded, interconnecting spacer strip about this aperture. After the lid outline is cut from the blank, the circumferential chuck panel, seaming panel and curl are formed to complete the gated lid.

7 Claims, 9 Drawing Figures

METHOD FOR THE MANUFACTURE OF A CAN LID HAVING A TRIPLE-FOLD, PUSHDOWN GATE

This invention relates to push-down gates in beverage can lids which are integral with the lid and are carried upon an underfolded edge portion about the gate opening.

Gated can lids of this type, wherein the gate is integral with the lid and is formed at an opening or aperture in the lid beneath an underfolded, interconnecting spacer strip about this aperture, are disclosed in the U.S. Pat. No. 3,334,775 issued to myself and to Kenneth E. Harper on Aug. 8, 1967. The structure is sometimes called a triple-fold, push-tab can lid, or a triple-fold can end.

Considerable effort has been expended to find the best mode of manufacture of such a lid or end. It is especially desirable to form a smoothly rounded opening with a maximum possible spacer strip width, so that a score line outlining the gate can be cut about the gate panel underneath the spacer strip. In this manufacture of lids, it has been assumed that the lid should be formed first, and the gate and spacer strip formed thereafter by suitable drawing and scoring operations. It was believed that if the circumferential chuck panel and curl, for attaching the lid to the body of a can, were drawn in the lid after the triple-fold gate was drawn and the score line cut, there would be a chance that the gate would rupture at the score line. In production operations, this could not be permitted, even if only a small percentage of ruptures occurred. Moreover, such a procedure was not even considered because in the manufacture of can lids with pulltab and other type gates, the can lid was completed before the gates were formed therein.

However, triple-fold can lids manufactured according to this accepted procedural sequence were not entirely satisfactory. The basic problem resided in the fact that whenever a triple-fold gate was formed in a can lid, the necessary draws to produce the aperture, the spacer strip and the gate involved stretching the metal in the can lid about the aperture. Where the circumferential seaming panel, chuck panel, curl, etc. were formed first, the drawing of metal to form these components restricted the metal available when the aperture for the gate was drawn. The types of metal which would be used were limited. The draw forming the aperture was not symmetrical, the amount of draw was limited and metal stretch problems existed especially at that portion of the aperture adjacent to the edge of the lid. Moreover, any draw which would disturb the radii adjacent the peripheral chuck panel will result in buckling of the can lid when the contents in the can are under pressure, as when they are pasturized. The result was a very narrow triple-fold with the spacer strip being a minimum. The score cutout lining the gate underneath the spacer strip had to be placed very close to the aperture, tending to minimize the advantage of the triple-fold, that is, a smooth, rounded aperture without sharp edges which might cut a user's finger. Finally, the forming of a triple-fold gate at one side of a preformed lid requires tooling with close dimensional tolerances, and which is subject to a shortened tool life due to normal wear.

One way to minimize the problems thus encountered was to form an oval or elongated aperture having a sharp radius at the point adjacent to the edge of the can lid. Such an aperture is not always desirable, and a circular aperture may be more desirable for several reasons. For example, when a circular aperture is formed as a triple-fold gate, the diameter of the gate will be greater than the diameter of the aperture at all points. Thus, if the gate were to be separated from the can lid when the gate is pushed downwardly and into the can, the gate cannot accidently pass through the aperture when someone is drinking the beverage within the can. With a structure having an oval or elongated gate, this is possible and instances could occur where individuals drinking from beverage cans could accidentally swallow the gate inside the can.

There is a real and definite need for the development of a process to produce an improved triple-fold gate in a can lid to overcome and obviate the disadvantages above set forth. With such a need in view, the present invention was conceived and developed and comprises, in essence, a process of forming a can lid with a triple-fold gate in the lid which involves a reversal of operational steps by forming the gate in a blank of metal before the components at the circular periphery of the lid are formed. It can be demonstrated that a well drawn triple-fold gate structure will pull metal in a symmetrical manner from a large area of the blank about the aperture and into the aperture. Also, that the score line underneath the spacer strip, defining the edge of the gate, would not rupture by subsequent drawing at the peripheral edge of the can lid. Also, that even though the drawing of an aperture would influence the metal in the blank a substantial distance from the edge of the aperture, this influenced metal would not affect the final draw of the chuck wall, chuck panel, etc. at the circular periphery of the can lid where an overlap of the previous draw occurred.

An important object of the invention is to provide a novel and improved method for producing a can lid having a triple-fold gate which can be formed from an increased number of different types of alloys, both of steel and aluminum, and of lighter base weight (thickness), and of harder tempered alloys for material saving purposes.

It follows that other objects of the invention are to provide a novel and improved method for producing a can lid having a triple-fold gate therein which: permits the formation of a triple-fold gate having a comparatively wide spacer strip between the lid and panel; which permits a gate to be placed in the lid with one edge being very close to the edges of the can; which permits the formation of any type of gate aperture in the lid and especially comparatively large, circular gate apertures; which permits an easy, symmetrical draw of metal with less precise tooling than would be otherwise necessary; which increases the tooling life; and which produces a reliable, low cost, neat appearing product.

With the foregoing and other objects in view, the present invention comprises certain constructions, combinations and arrangements of parts and elements, as hereinafter described, defined in the appended claims and shown in the accompanying drawing, in which:

Figure 4:
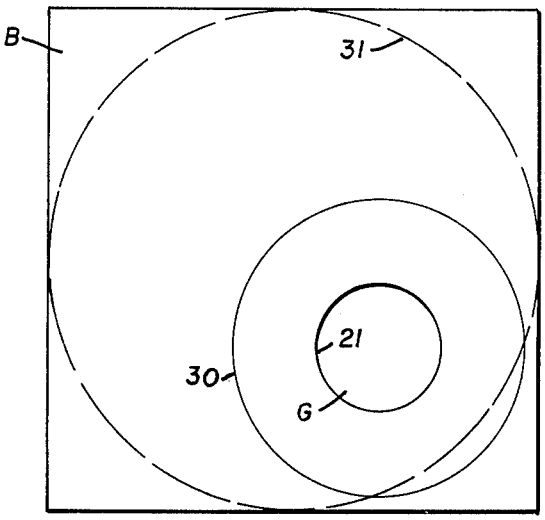

FIG. 4 is a plan view of a square blank of metal from which a can lid may be manufactured, the blank having therein, at a suitable location, a finished triple-fold gate beneath a circular aperture, this figure indicating in a light-weight line the area of metal about the aperture which is disrupted by forming the aperture and gate and in a broken line, the circular outline of the lid before the circumferential edge portions of the lid are drawn.

Figure 5:
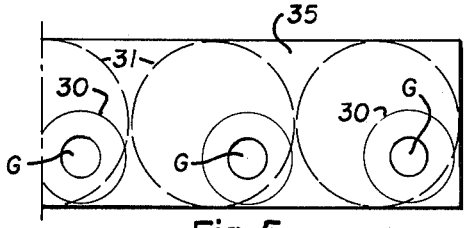

FIG. 5 shows, on a small scale, a strip of metal wherefrom a series of lids may be formed with the triple-fold gates therein, the areas of disrupted metal about the gate apertures being shown in light-weight lines and with the outlines of the lids being shown in broken lines.

Figure 6:
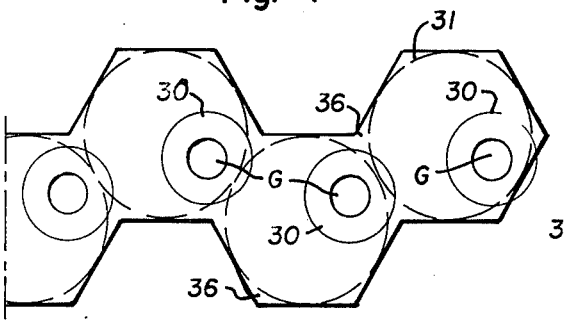

FIG. 6 illustrates a scrolled strip from which a sequence of lids may be formed, with the triple-fold gates therein, with the areas of disrupted metal about the gate apertures being shown in light-weight lines and with the outlines of the lids being shown in broken lines.

Figure 7:
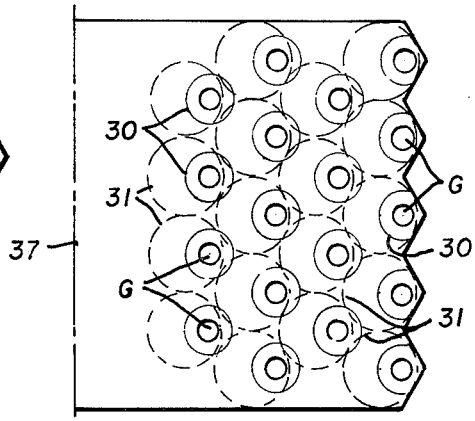

FIG. 7 is a small scale view of a comparatively wide strip of lid metal having triple-fold gates therein with the areas of disrupted metal about the gate apertures being shown in light-weight lines and with the outlines of the lids being shown in broken lines.

Figure 1:
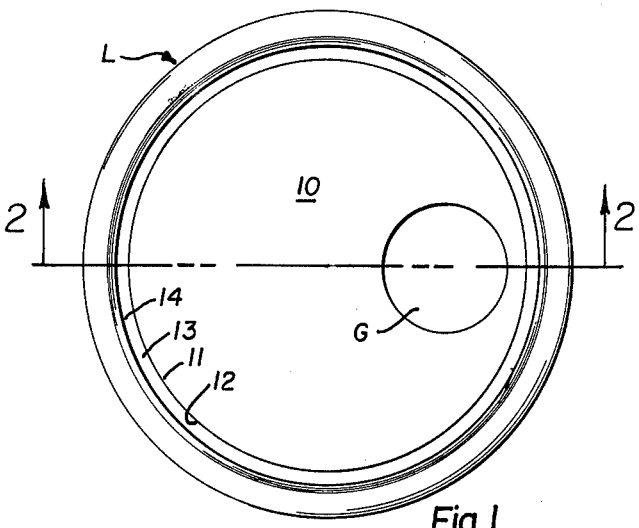
FIG. 1 is a plan view of a can lid having a circular aperture therein which may be formed according to the principles of the present invention.
Figure 3:
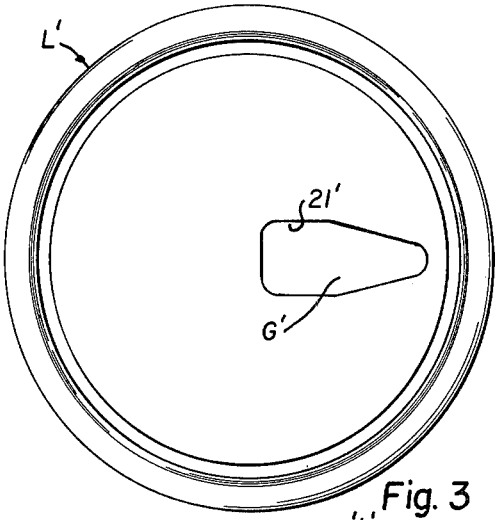
FIG. 3 is a plan view similar to FIG. 1, but illustrating an elongated aperture which has a sharp radius adjacent to the edge portion of the can lid.
Figure 2:
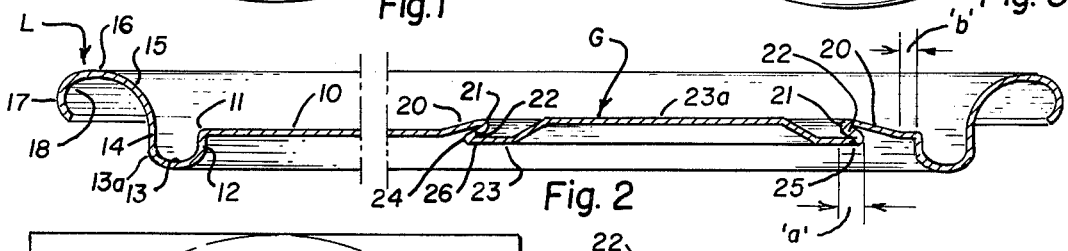
FIG. 2 is a transverse sectional detail of the lid shown at FIG. 1, but on a greatly enlarged scale and with a portion broken away to conserve space.

Referring more particularly to the drawing, the can lid L, shown at FIGS. 1 and 2, is essentially conventional in form and with a circular push-down gate G at one side of the lid. FIG. 3 is similar to FIG. 1, but the gate G' is elongate in form. A conventional can lid is formed with a connective circumferential edge for attachment to the end of the cylindrical wall of a can. The lid will include a flat, central expansion panel 10. The panel is circumscribed by a connecting and seaming circular edge which includes, at the peripheral boundary of the expansion panel, a short, downturned expansion radius 11 which turns to a chuck panel radius 12 having its bottom forming a chuck panel 13 with an outward chuck panel radius 13*a* to an upwardly extended chuck wall 14. The upper crest of this chuck wall is turned into a seaming panel radius 15 from whence a circular seaming panel 16 outstands, with the outward edge of the seaming panel being downturned and inturned to form a curl 17. A latex seal coat 18 is provided at the inner portion of the seaming panel to complete the connective circumferential edge. The formation of this connective circumferential edge of the lid is conventional and need not be further described.

Figure 2A:
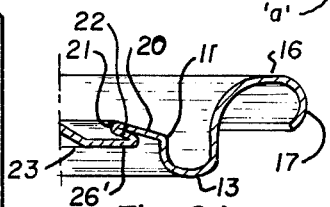
FIG. 2A is a fragmentary sectional detail similar to a portion of FIG. 2, but showing an alternate position of the gate hinge portion attaching the gate to the lid.

The triple-fold gate G is formed in the expansion panel of the lid and includes an upper, annular portion 20 which is inclined upwardly from the surface of the panel at a small angle to an aperture 21 which is circular, as shown at FIG. 1, but which may be an elongated aperture 21', as shown at FIG. 3. The metal within the aperture is downfolded and folded underneath the aperture to form a spacer strip 22 and a panel 23 wherein the gate G is formed. Accordingly, the fold 24 between the spacer strip 22 and the panel 23 will lie underneath the aperture fold 21. To define the gate G, a score line 25 or an offset shear line, not shown, is cut or formed about the edge of the panel 23, adjacent to the fold 24 and beneath the spacer strip 22. This score line 25 extends continuously about the panel except at a short hinge area 26, which will hold the gate on the lid when it is pushed downwardly to open the can. This hinge area 26 may be at the inward side of the lid panel 10, as shown at FIG. 2, or it may be adjacent to the outer edge of the lid panel, as at 26' shown at FIG. 2A.

The score line 25 may be cut into the panel 23, as with a knife-like tool, to define the gate or it may be a shear offset, as mentioned, formed with shearing dies. It is to be noted that the entire score line 25 may cut completely through the panel 23 or the score line may cut completely through only a short portion of the gate panel with the remainder of the cut being only partially through the panel, with the partial cut being such that the gate will tear away from the panel as it is pushed downwardly. A sealant such as wax may be used at this score cut 25, see U.S. Pat. Nos. 3,905,513 and 3,980,200. Also, the score cut may not be extended through the panel at all, but it will be such that pushing the gate downwardly will rupture or shear the metal at the score line and tear the gate from the panel. The gate G may be dished, as illustrated at 23*a*, or it may be flat, or downwardly dished in any suitable manner to facilitate rupturing and tearing the metal at the score line 25 when the gate is pushed downwardly.

The formation of the gate G and the triple-fold aperture above it will follow a fixed procedure, whether the gate is circular, as shown at FIG. 1, or elongated, as shown at FIG. 3. This formation procedure will include drawing a cup within the boundary of the aperture followed by expanding the sidewall of the cup and flattening the wall and bottom to produce the spacer strip 22 and gate panel 23 underneath the aperture. The actual drawing operations can follow procedures which are essentially conventional and need not be described in detail.

It is to be noted that two important dimensions will exist insofar as the drawing operations are concerned. A first dimension '*a*', shown at FIG. 2, is the width of the spacer strip 22 underneath the aperture. It is desirable to have the spacer strip 22 as wide as possible, so that a cut score line 25, defining the gate G in the panel 23, will be completely underneath the spacer strip, and such that the gate G will be wider than the aperture 21. The other dimension, '*b*', shown at FIG. 2, is the distance the edge of the aperture will be from the edge of the finished can and is best defined as the distance from the radius 11 at the edge of the expansion panel 10. It is desirable to keep this dimension '*b*' small, to place the edge of the aperture close to the edge of the finished can. This facilitates pouring the contents from the can and makes drinking from the can much easier. In conventional operations where the can lid and its peripheral edge folds are formed before the gate is formed, it was found that the amount of metal at the edge of the lid was insufficient to effect a good draw. A sharp radius at this edge of the aperture was necessary, as shown at FIG. 3 and as heretofore mentioned.

Figure 2B:
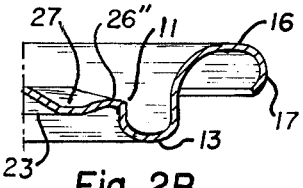
FIG. 2B is a fragmentary sectional detail similar to FIG. 2A, but showing an alternate construction using an offset hinge portion.

FIG. 2B shows a gate hinge 26'' formed where there is an interrupted triple-fold with the interruption 27 occurring at the gate hinge 26'' as illustrated. The interrupted triple-fold construction is disclosed in my U.S. Pat. No. 3,951,298, issued Apr. 20, 1976, and need not be described further, except to note that when a lid is formed with this construction according to the present invention, the hinge may be located very close to the edge of the can lid by placing the hinge at the edge as illustrated at FIG. 2B. Any excess metal at hinge 26'' of the interrupted triple-fold can be absorbed in the later peripheral forming operations.

According to the present invention, a triple-fold gate G is formed in a blank B, FIG. 4, before the lid is formed. The drawing of the triple-fold gate is accomplished by conventional steps which need not be described in detail. The first step is to draw a cup which defines the aperture 21. This cup must be deep enough to provide sufficient metal to expand the walls and to subsequently permit the spacer strip 22 and the gate panel 23 to be formed as previously described. The draw to form this cup will pull metal from the blank a significant distance about the aperture 21, as indicated at the disturbed area 30 in FIG. 4. This disturbance to the metal, created by die pressure and by pulling some of the metal through its yield point, can be easily seen after the cup is formed. When a circular aperture is drawn, the disturbed area 30 will form a circle about the aperture whenever metal is available from all sides of the aperture. It follows that whenever the triple-fold gate is located at a point near the edge of the can, the disturbed area 30 of metal can reach beyond the outline 31 of the lid in the blank B. This disturbed area, however, should not reach beyond the edge of the blank and thus, the triple-fold gate G should be located near a corner of the blank as shown. Where other patterns of blanks, other than the square blanks shown at FIG. 4 are used, which significantly reduce waste metal, it may be necessary to form the triple-fold gates in the sheet metal before the blanks are cut and the disturbed area 30 may even have to reach into other adjacent lid areas as indicated at FIGS. 6 and 7 and hereinafter described.

After the triple-fold gate is drawn and formed in the blank B, other drawing operations will cut out the circular lid from the blank and form the several peripheral radii, panels and the curl 17 about the lid panel 10 to complete the lid. It is to be noted that these peripheral radii, panels and the curl 17 may be well within the disturbed area of metal about the gate aperture 21, especially if the aperture is to be close to the edge of the finished can lid. However, it was found that this disturbed area 30 would not significantly affect the formation of the radii panels and the outer curl 17. Moreover, it was found that drawing the outer periphery of the lid would not cause metal to stretch at the aperture 21 in such a manner as to rupture the score line 25 or otherwise damage the gate panel 23.

Rather than using an individual blank B shown at FIG. 4, can lids are usually produced from strips or webs of flat sheet metal. FIG. 5 shows a straight web 35 having a width sufficient to form lid outlines 31. Triple-fold gates are formed on this strip at locations which place them adjacent to corners where an excess of metal exists so the outline of disturbed metal will remain in the strip. FIG. 6 shows a scrolled strip 36 where the lids are staggered to produce a more compact arrangement of lid outlines 31 and with a minimum of waste material. Here the triple-fold gates are formed in the strip at locations between the undulations which cause the disturbed area 30 of metal about the gates to reach into the adjacent lid outlines 31. When the gates are formed before the lid outlines are cut, this overlapping of disturbed metal will create no problems. FIG. 7 shows a comparatively wide strip 37 where rows of lids are formed in a staggered, hexagonal, honeycomb pattern to produce a maximum number of lids from a given amount of sheet metal. Ordinarily, such a wide strip will use multiple die cutting rows of lids in one step. Prior to this, the row of triple-fold gates will be formed, the sheet thereafter positioned for cutting the lid outlines 31. Again, the area of metal disturbance about each gate aperture, indicated at 30, will reach into the edges of adjacent lid outlines 31 and again, the effect of this was found to be immaterial when the lids were finished.

I have now described my invention is considerable detail. However, it is obvious that others skilled in the art can build and devise alternate and equivalent constructions which are nevertheless within the spirit and scope of my invention. Hence, I desire that my protection be limited, not by the constructions illustrated and described, but only by the proper scope of the appended claims.

I claim:

1. A method for the manufacture of a gated can lid preparatory to attaching the lid to the body of a can, said method including the steps of:

forming a triple-fold gate in a blank of metal which will constitute the can lid by drawing a cup in an aperture, folding the wall of the cup to form an interconnecting spacer strip underneath the aperture and a gate panel beneath the spacer strip, and at least partially outlining the gate with a cut in the panel underneath the spacer strip, the gate being disposed at a location offset from the center of the can lid and the drawing of the cup being such as to effect an area of disturbed metal about the gate aperture extending beyond the periphery of the can lid; and thereafter blanking the can lid through the area of disturbed metal, forming a peripheral circumferential chuck panel, a seaming panel, and a curl to complete the lid.

2. The method defined in claim 1, wherein:

the cut is effected by a score line.

3. The method defined in claim 1, wherein:

the cut is effected by a shear to offset the gate from the panel.

4. The method defined in claim 1, wherein:

the cut extends completely about the panel excepting for a hinge portion adjacent to the center of the blank.

5. The method defined in claim 1, wherein:

the cut is extended completely about the panel except at a hinge portion adjacent to the outer edge of the blank.

6. The method defined in claim 1, wherein:

the spacer strip is extended about the aperture except at a short hinge portion; and a simple offset of metal is extending from the aperture to the panel at said hinge portion.

7. The method defined in claim 1, wherein:

said hinge portion is positioned at the outer edge of the lid and adjacent to the circumferential chuck panel.

* * * * *